US010167106B2

(12) United States Patent
Kasper et al.

(10) Patent No.: US 10,167,106 B2
(45) Date of Patent: Jan. 1, 2019

(54) STORAGE BOX WITH FILL VIEWER

(71) Applicants: Joseph A Kasper, Lexington, KY (US); Steven B Ruble, Lexington, KY (US)

(72) Inventors: Joseph A Kasper, Lexington, KY (US); Steven B Ruble, Lexington, KY (US)

(73) Assignee: Valvoline Licensing and Intellectual Property, LLC, Lexington, KY (US)

( * ) Notice: Subject to any disclaimer, the term of this patent is extended or adjusted under 35 U.S.C. 154(b) by 0 days.

(21) Appl. No.: 15/293,892

(22) Filed: Dec. 24, 2016

(65) Prior Publication Data

US 2018/0178941 A1 Jun. 28, 2018

(51) Int. Cl.

| | |
|---|---|
| ***B65D 5/42*** | (2006.01) |
| ***B65D 77/06*** | (2006.01) |
| ***B65D 5/74*** | (2006.01) |
| ***B65D 5/468*** | (2006.01) |
| ***B65D 25/28*** | (2006.01) |
| ***B65D 25/42*** | (2006.01) |
| ***B67D 7/04*** | (2010.01) |
| ***B65D 25/54*** | (2006.01) |
| ***B67D 7/00*** | (2010.01) |
| *B67D 7/84* | (2010.01) |

(52) U.S. Cl.

CPC ..... *B65D 5/4204* (2013.01); *B65D 5/4608* (2013.01); *B65D 5/746* (2013.01); *B65D 25/2802* (2013.01); *B65D 25/2897* (2013.01); *B65D 25/42* (2013.01); *B65D 25/54* (2013.01); *B65D 77/067* (2013.01); *B65D 77/068* (2013.01); *B67D 7/005* (2013.01); *B67D 7/04* (2013.01); *B67D 7/84* (2013.01)

(58) Field of Classification Search

CPC .... B65D 5/4204; B65D 5/4608; B65D 5/746; B65D 25/2802; B65D 25/42; B65D 77/068; B67D 7/04; B67D 7/3209; B67D 7/84

See application file for complete search history.

(56) References Cited

U.S. PATENT DOCUMENTS

| | | | | | |
|---|---|---|---|---|---|
| 3,756,471 | A * | 9/1973 | Wissman | B65D 5/4204 | 222/156 |
| 6,109,315 | A * | 8/2000 | Stern | B65D 77/06 | 141/114 |
| 2008/0237320 | A1* | 10/2008 | Philips | B65D 5/28 | 229/109 |
| 2011/0266287 | A1* | 11/2011 | Groesbeck | B65D 5/4204 | 220/592.01 |
| 2013/0112739 | A1* | 5/2013 | Philips | B65D 77/065 | 229/117.27 |
| 2014/0083340 | A1* | 3/2014 | Dull | A01C 23/008 | 111/120 |

* cited by examiner

*Primary Examiner* — Corey N Skurdal
(74) *Attorney, Agent, or Firm* — Francis Law Firm PLLC; James M. Francis

(57) ABSTRACT

A storage box having a fill viewer created when the negative space of the box flaps are combined when the flaps are folded to close the box.

8 Claims, 8 Drawing Sheets

Fig. 3
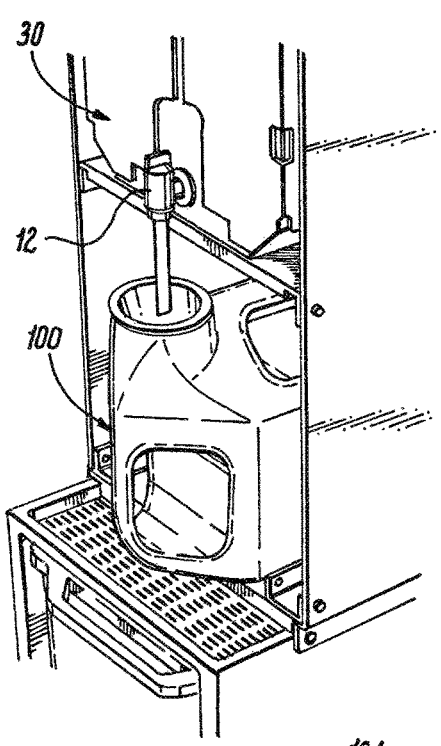
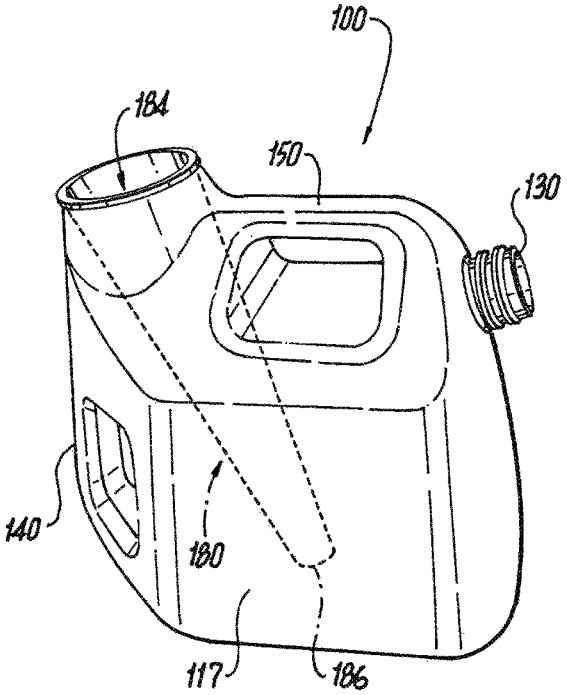
Fig. 4
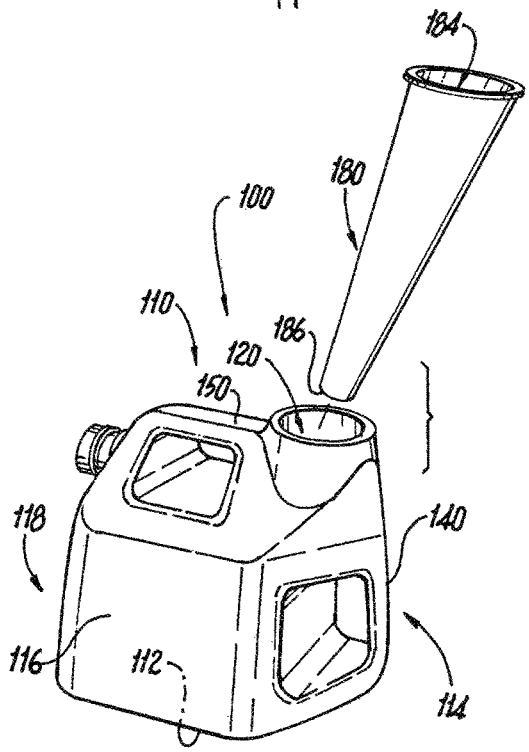
Fig. 5

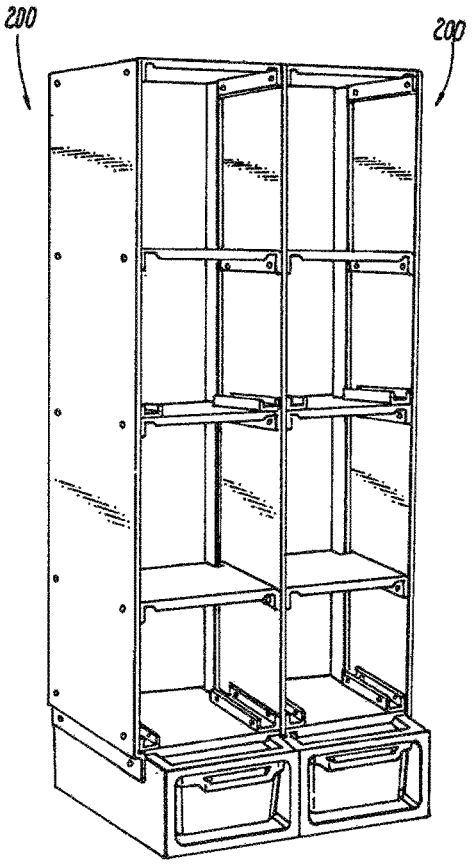
Fig. 11c
Fig. 11d
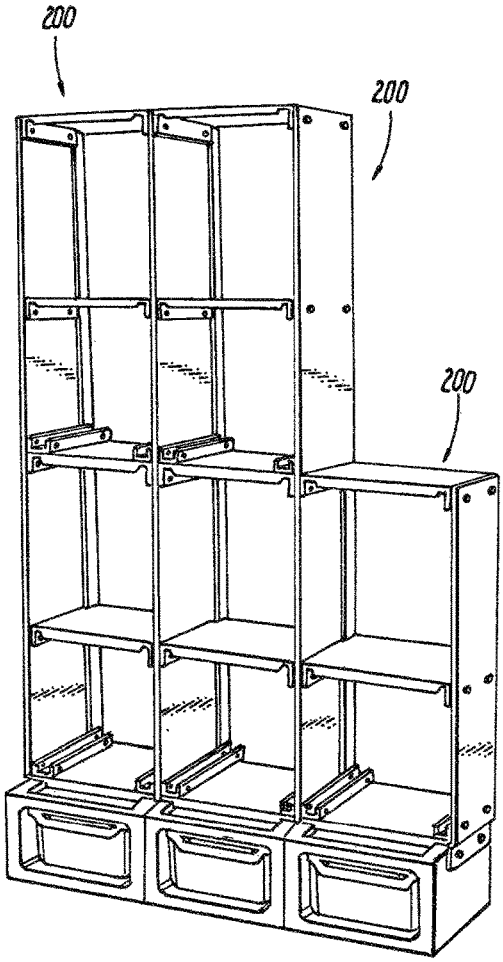

STORAGE BOX WITH FILL VIEWER

CROSS REFERENCE TO RELATED APPLICATIONS

This application claims priority from U.S. Provisional Application 62/239,324 filed Oct. 9, 2015 and is a continuation-in-part of U.S. Utility patent application Ser. No. 15/219,488 filed Jul. 26, 2016.

TECHNICAL FIELD

The system of the present application relates generally to storage boxes. More specifically, the device of the present application relates to a storage box for liquids possessing a window which allows the user to ascertain the quantify the contents.

SUMMARY

The present application discloses a fill viewer for a bag housing utilized in a lubricant bag box dispensing system which utilizes a lubricant bag having an integrated spigot at its base. The lubricant bag is housed within a chamfered bag housing having a spigot port through which the lubricant bag's spigot passes. The bag housing further possesses a vertical sight, i.e. window, formed from the negative space left between the folded flaps of the assembled bag housing, and hand ports which are used as handles.

An ergonomic lubricant dispensing jug is also disclosed. The jug possesses a wide base to lower the center of gravity and lubricant fill port at the rear of the jug. A fill port containment wall extends vertically from the boundary of the fill port and acts to further minimize the chance for spillage and splashing. A removably attached funnel is nested on the jug spout.

A modular rack system is disclosed that houses the lubricant bag box above the ergonomic lubricant dispensing jug. The modular rack system also serves to align the spout of the lubricant bag box above the lubricant dispensing jug's fill port for spill free filling.

BRIEF DESCRIPTION OF THE DRAWINGS

FIG. 3 depicts a front-right perspective view of an embodiment of a modular rack system in use with a lubricant filled box and a lubricant dispenser.

FIG. 4 depicts a left-side perspective view of an ergonomic lubricant jug and funnel.

FIG. 5 depicts an exploded view of an ergonomic lubricant jug and funnel.

FIGS. 11*a* through 11*d* depict perspective views of embodiments of assembled shelving modules.

DETAILED DESCRIPTION OF THE PREFERRED EMBODIMENTS

The present application describes various embodiments of a lubricant bay box dispensing system.

Figure 1:
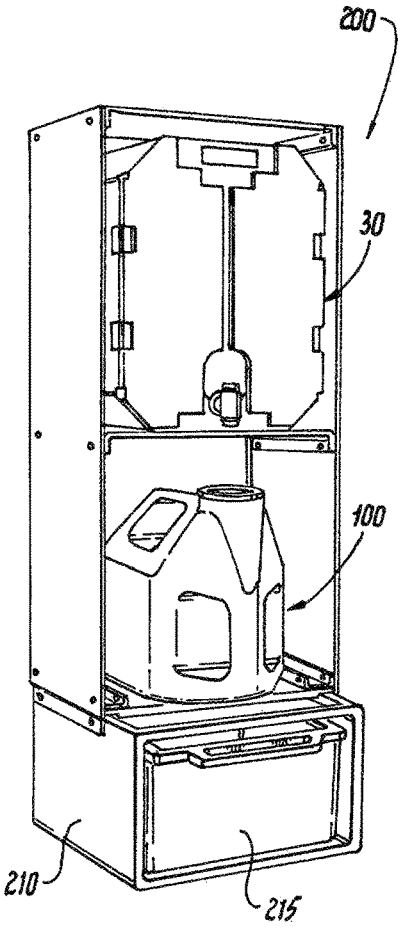
FIG. 1 depicts a front-left perspective view of an embodiment of the modular rack system housing a lubricant filled box and a lubricant dispenser.

As depicted in FIG. 1, lubricant 1 is stored within and ultimately dispensed from a sealed flexible reservoir bag 10. The reservoir bag 10 preferably possesses a reservoir bag base 14, proximal face 15, distal face 16, top 17, first side face 18, and second side face 19. The reservoir bag 10 is preferably made from a high density polymer to form a puncture resistant carrier and possesses dispenser 12, e.g. a spigot assembly 12 or functionally similar means to control the dispensing of lubricant from the reservoir bag base 14 via a gravity feed.

Figure 2:
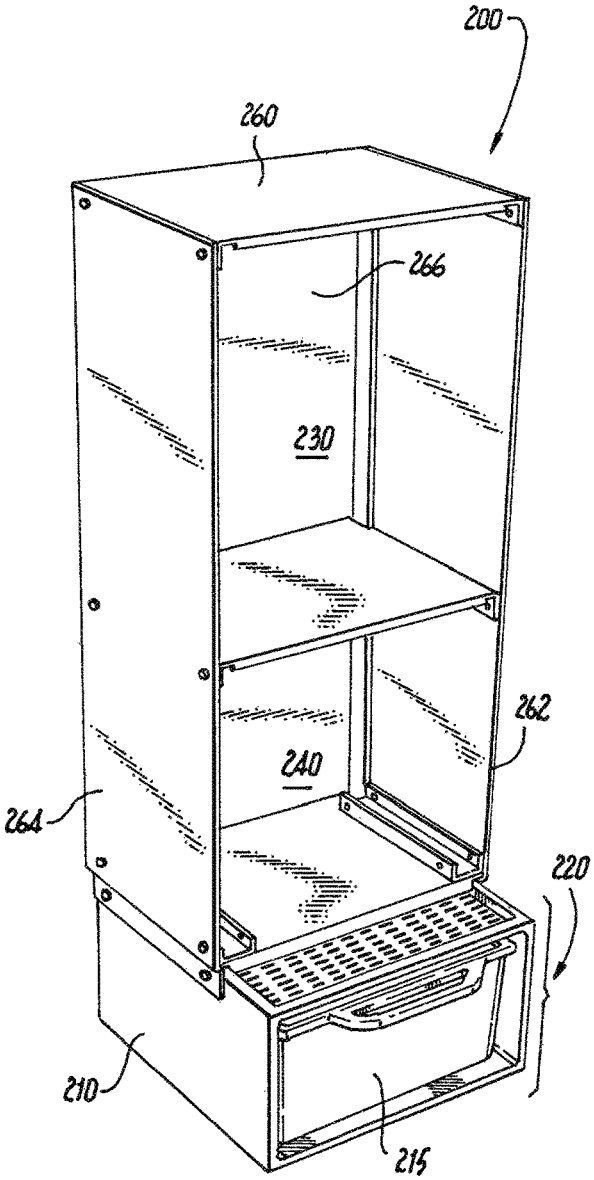
FIG. 2 depicts a front-left perspective view of an embodiment of a modular rack system.
Figure 6:
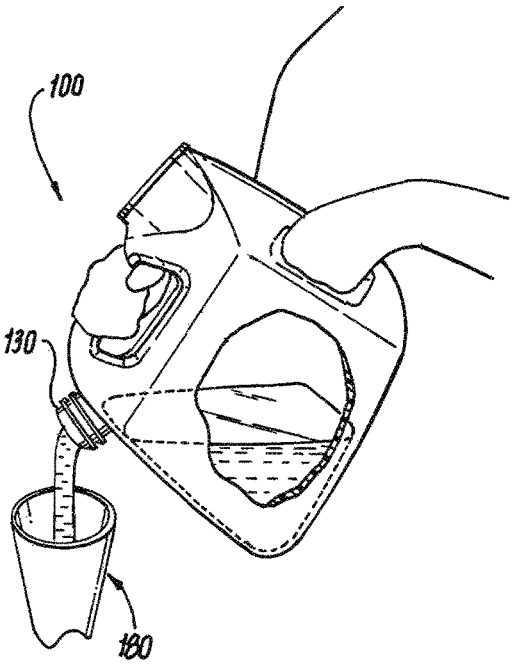
FIG. 6 depicts a left-side perspective view of a lubricant filled ergonomic lubricant jug in use with a funnel.
Figure 7:
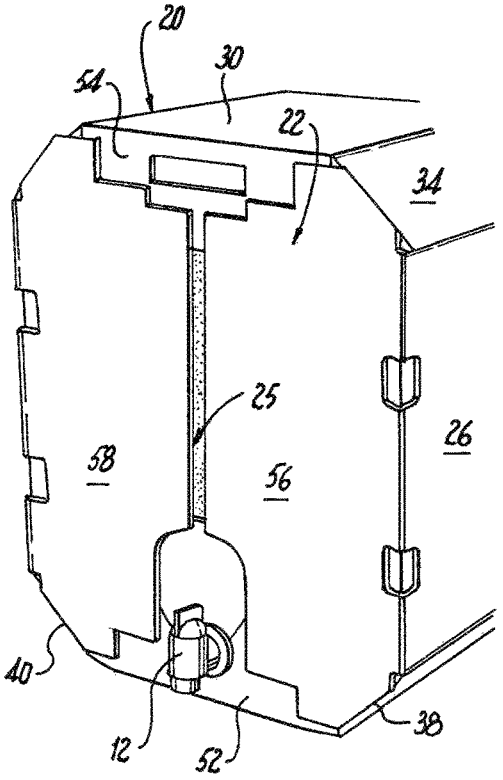
FIG. 7 depicts a partial front-right perspective cutaway view of a bag housing for a lubricant filled bag.
Figure 8:
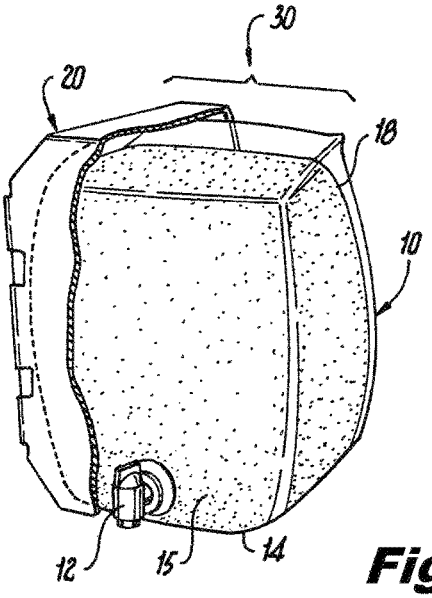
FIG. 8 depicts a perspective cutaway view of a bag housing encasing a lubricant filled bag.
Figure 9:
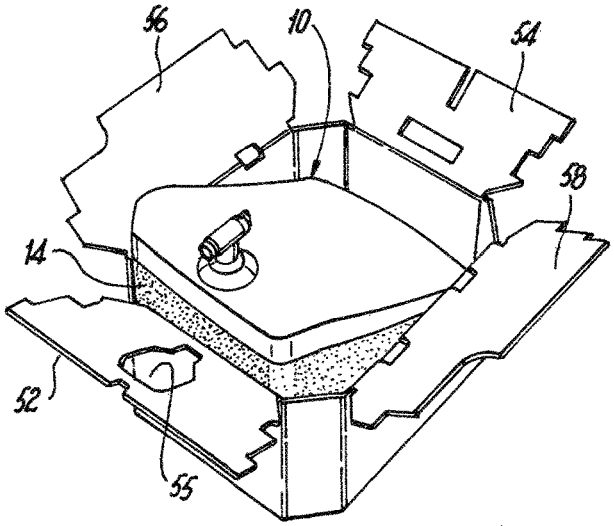
FIG. 9 depicts a perspective view of an unassembled bag box and lubricant bag.
Figure 10:
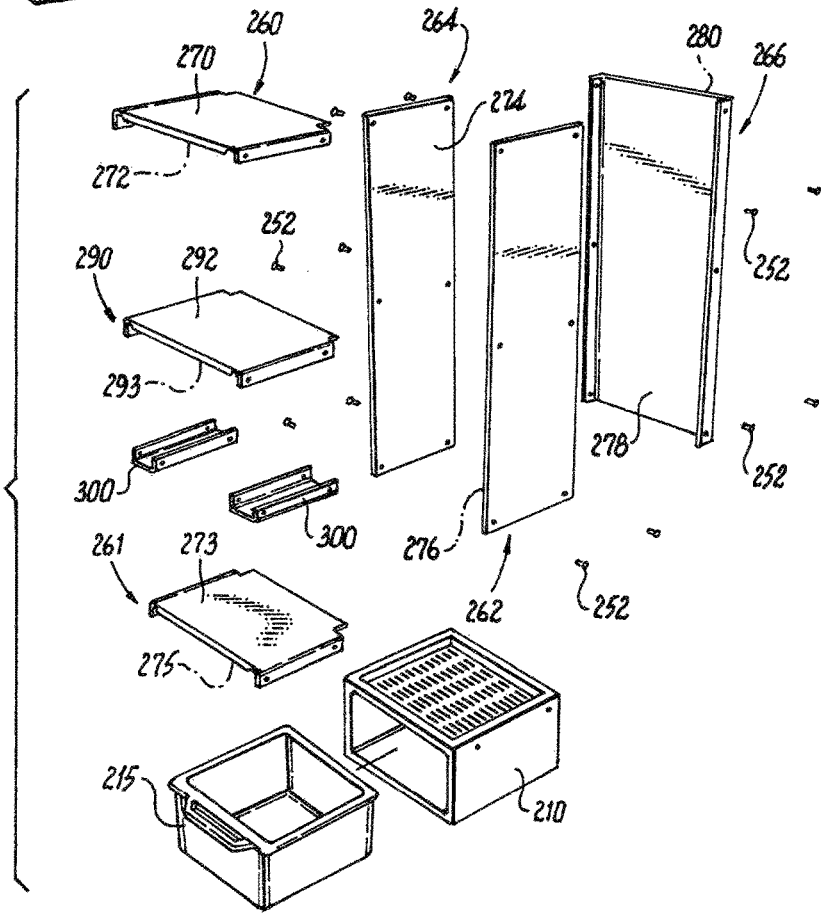
FIG. 10 depicts an exploded view of a shelving module and drain pan module.
Figure 11A:
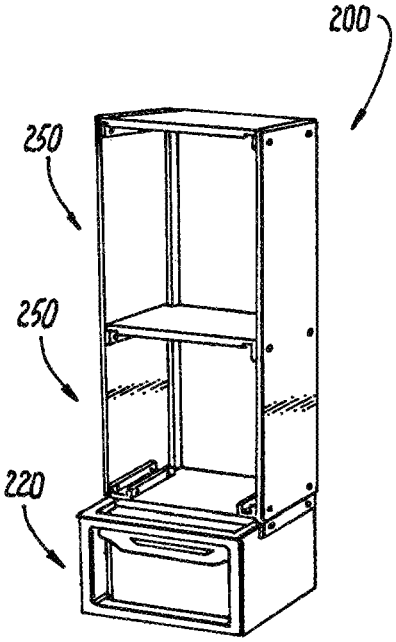
Figure 11B:
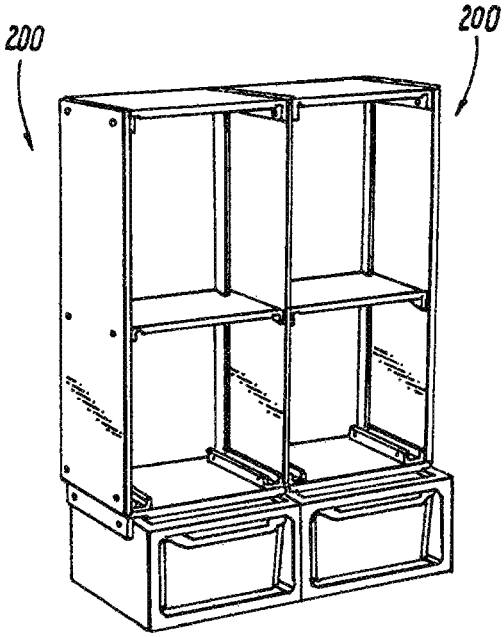
Figure 12:
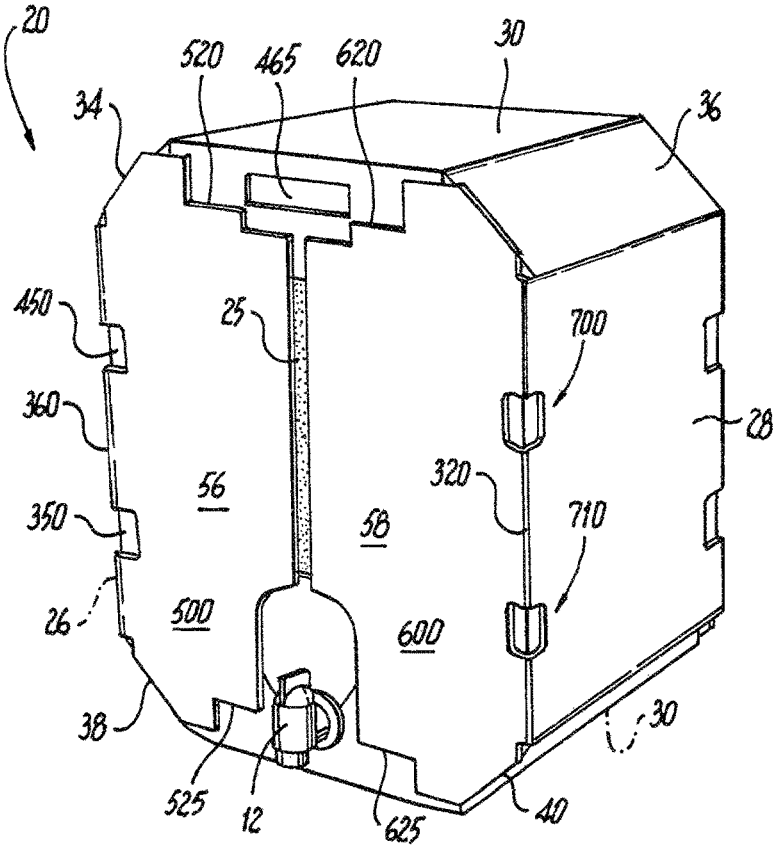
FIG. 12 depicts a right perspective view of the bag housing.
Figure 13:
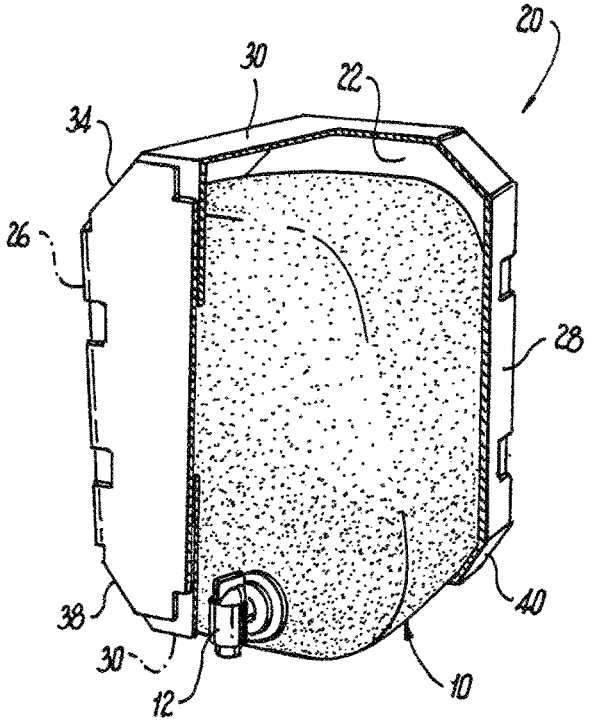
FIG. 13 depicts a perspective cutaway view of a bag housing encasing a lubricant filled bag.
Figure 14:
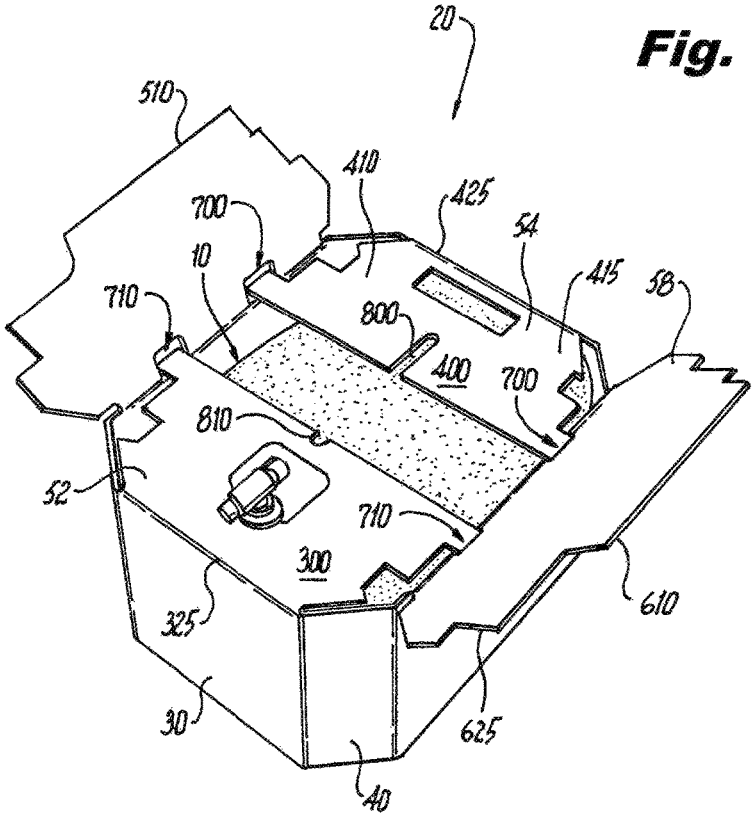
FIG. 14 depicts a bottom right perspective view of a partially assembled bag housing.
Figure 15:
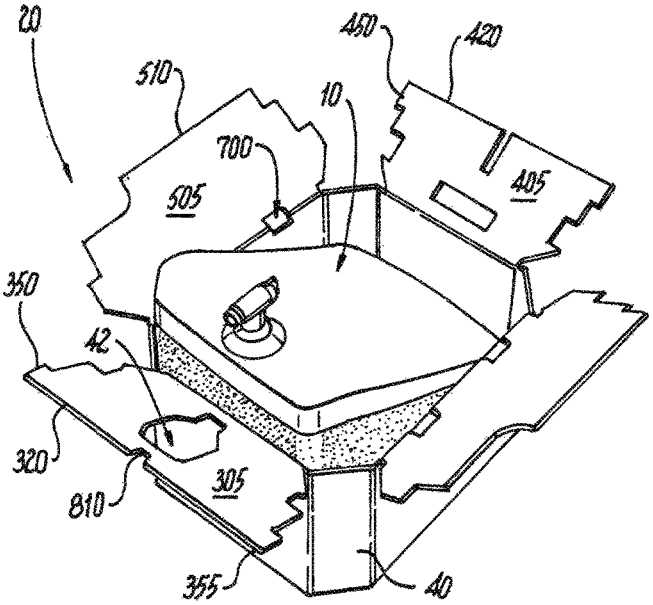
FIG. 15 depicts a bottom right perspective view of a partially assembled bag housing.

The lubricant filled reservoir bag 10 is contained within a bag housing 20 as depicted in FIG. 2. The combination of the assembled reservoir bag 10 and reservoir bag housing 20 is referred to herein as the bag box 20.

A bag housing 20 is preferably constructed of cardboard and is sufficiently rigid to contain and protect a lubricant filled reservoir bag 10 housed therein. The assembled bag housing 20 is a preferably a box having a proximal wall 22, a distal wall 24, a first lateral wall 26, a second lateral wall 28, a top wall 30, a base wall 32, a first top chamfered wall 34, a second top chamfered wall 36, a first base chamfered wall 38, and a second base chamfered wall 40. A spigot port 42 at the base of the proximal wall 22 allows the bag's integrated spigot 12 to be pulled through the proximal wall 22 so as to allow the spigot 12 reside outside of the reservoir bag housing 20 while the reservoir bag 10 is housed within the bag housing 20. The chamfered walls 34, 36, 38, 40 add structural strength to the bag housing 20. Moreover, the first and second base chamfered walls 38,40 decrease the available space for the lubricant filled bag at the bottom of the bag housing 20, thereby increasing pressure and improving flow through the spigot 12.

The bag housing 20, i.e. bag box 20, preferably has four proximal flaps 52,54,56,58 that fold together to create the proximal wall 22, i.e. a proximal base flap 52, a proximal top flap 54, a first proximal lateral flap 56, and a second proximal lateral flap 58. The bag housing 20, i.e. bag box 20, also preferably has four distal flaps 51 that fold together to create the distal wall 24, i.e. a distal base flap 252, a proximal top flap 254, a first proximal lateral flap 256, and a second proximal lateral flap 258. The proximal base flap 52 possesses a spigot flap orifice 55 through which a spigot 12 may pass. Ideally, the bag housing 20 possesses a vertical bag sight port 25, i.e. fill viewer 25 or window 25, to permit the volume of lubricant 1 remaining in the bag to be readily ascertained. The sight port 25 is partially created from the negative space, i.e. a gap, left between the proximal flaps 52,54,56,58 when they are folded together.

The proximal base flap 52 possesses a proximal face 300, a proximal base flap distal face 305, a proximal base flap first lateral side 310, a proximal base flap second lateral side 315 a proximal base flap top side 320, and a proximal base flap base side 325 affixed to the base wall 32 along the base wall-proximal base flap edge 340 so as to permit the proximal base flap 52 to rotate about the base wall-proximal base flap edge 340 and fold up to form part of the proximal wall 22. The proximal base flap 52 possesses a first proximal base flap tab 350 projecting laterally toward the first lateral wall-proximal flap edge 360 from the proximal base flap first lateral side 365 and a second proximal base flap tab 355 projecting laterally toward the second lateral wall-proximal flap edge 370 from the proximal base flap second lateral side 315. The proximal base flap 52 further possesses a spigot port 42 through which a spigot 12 may pass. When the proximal base flap 52 is folded upwards to form part of the proximal wall 22, the spigot port 42 substantially aligns with the spigot 12 of an internally housed container 10 so that the spigot 12 may pass through the proximal base flap 52 so as to place the spigot 12 outside of the box 20 for access by a user.

The proximal top flap 54 possesses a proximal top flap proximal face 400, a proximal top flap distal face 405, a proximal top flap first lateral side 410, a proximal top flap second lateral side 415, a proximal top flap base side 420, and a proximal top flap top side 425 affixed to the top wall 30 along the top wall-proximal top flap edge 460 so as to permit the proximal top flap 54 to rotate about the top wall-proximal top flap edge 460 and fold down to form part of the proximal wall 22. The proximal top flap 54 possesses a first proximal top flap tab 450 projecting laterally toward the first lateral wall-proximal flap edge 360 from the proximal top flap first lateral side 410 and a second proximal top flap tab 455 projecting laterally toward the second lateral wall-proximal flap edge 370 from the proximal top flap second lateral side 415. Ideally, the proximal top flap 54 possesses a handle port 465 to facilitate carrying of the box 20.

The first proximal lateral flap 56 is affixed to the first lateral wall 26 along the first lateral wall-proximal flap edge 260 so as to permit the first proximal lateral flap 56 to rotate about the first lateral wall-proximal flap edge 360. The first proximal lateral flap 56 possesses a top side 520, a bottom side 525, a proximal face 500, a distal face 505, a first side 515, and a second side 510 joined to the first lateral wall 26. The second proximal lateral flap 58 is affixed to the second lateral wall 28 along the second lateral wall-proximal flap edge 370, i.e. second lateral wall-proximal flap edge seam 370, so as to permit the second proximal lateral flap 58 to rotate about the second lateral wall-proximal flap edge 370. The second proximal lateral flap 58 possesses a top side 620, a bottom side 625, a proximal face 600, a distal face 605, a first lateral side 610, and a second face 615 joined to the second lateral wall 28.

The first lateral wall-proximal flap edge 360 possesses a proximal base flap tab port 700 and a proximal top flap tab port 710. The second lateral wall-proximal flap edge 370 also possesses a proximal base flap tab port 700 and a proximal top flap tab port 710. The proximal top flap tab ports 710 and the proximal base flap tab ports 700 are sized and arranged to receive the top flap tabs 450,455 and base flap tabs 350,355 in a friction fit arrangement so as to secure the proximal base flap 52 and proximal top flap 54 into position so that the proximal base flap 52 and proximal top flap 54 substantially lie in the same plane as they form part of the proximal wall 22. The proximal lateral flaps 52,54, 56,58 fold so as to form part of the proximal wall 22 when the proximal lateral flaps 56,58 proximally overlay the proximal top flap 54 and proximal base flap 52 that are secured into position by their tabs 350,355,450,455 that are secured into the tab ports 700,710.

The proximal base flap 52 further possesses base sight notch 800 formed from a vertical notch extending from the proximal base flap top edge 320 toward the proximal base flap base side 325 so as to form part of the sight port 25. The proximal top flap 54 possess a top sight notch 810 formed from a vertical notch extending from the proximal top flap base side 420 toward the proximal top flap top side 425 so as to form part of the sight port 25. Ideally, the base sight notch 800 and the top sight notch 810 are horizontally aligned so that they form a continuous vertical negative space when the proximal top flap 54 and the proximal base flap 52 are secured so as to form part of the proximal wall 22.

The first proximal lateral flap 56 is affixed to the first lateral wall 26 along the first lateral wall-proximal flap edge 360. The second proximal lateral flap 58 is affixed to the second lateral wall 28 along the first lateral wall-proximal flap edge 340. The first lateral wall-proximal flap edge 340 possesses a proximal base flap tab port 710 and a proximal top flap tab port 700. The second lateral wall-proximal flap edge 370 also possesses a proximal base flap tab port 710 and a proximal top flap tab port 700.

The width of the first proximal lateral flap 56 as measured from the first lateral wall-proximal flap edge 360 to the proximal lateral flap second lateral side 510 is less than half the width of the box 20 from the first lateral wall 26 to the second lateral wall 28. The width of the second proximal lateral flap 58 as measured from the second lateral wall-proximal flap edge 370 to the proximal lateral flap first lateral side 610 is less than half the width of the box 20 from the first lateral wall 26 to the second lateral wall 28.

When the first and second proximal lateral flaps 56,58 are folded to form the proximal wall 22, a vertical gap is left between the first proximal lateral flap second lateral side 510 and the second proximal lateral flap first lateral side 610 so as to allow the viewing of the box 20 contents and arranged so as to not obstruct the top sight notch 800 and the base sight notch 810 to create a vertical sight 25 from the negative space between the proximal flaps 52,54,56,58 through which the contents of the box 20 can be viewed and quantified. The vertical sight 25 is formed from the negative space left between the proximal flaps 52,54,56,58 folded so as to form the proximal wall 22.

An ergonomic lubricant dispensing jug 100 is utilized to receive the lubricant 1 from the bag box 30 and to transport it to a lubrication point, e.g. an engine being serviced. The lubricant dispensing jug 100 preferably possesses a top 110, base 112, proximal side 114, distal side 116, a first lateral side 117, and a second lateral side 118. A lubricant fill inlet 120 is sited at the top of the jug 100 along its proximal side 114. The lubricant fill inlet 120 is used to fill the lubricant dispensing jug, i.e. jug, with a lubricant 1. The lubricant 1 is intended to flow into the lubricant fill inlet 120 when the jug 100 is placed below the bag box 30 and the spigot 12 is vertically aligned with the lubricant fill inlet 120.

The jug 100 preferably possesses a first jug handle 140 along its proximal side 114 in the jug's proximal-distal plane. In an alternative embodiment, a second jug handle 150 runs along the top of the jug 100 parallel to the horizontal axis extending from the distal side 116 to the proximal side 114 and in line with a plane extending from the jug top 110 to the jug base 112. The first jug handle 140 is ergonomically positioned substantially in the center of the distal side 116 of the jug and above the jug base 112 so as to typically keep the center of gravity of the lubricant filled jug 100 below the user's hand. The jug 100 further possesses a removable funnel 180 having a funnel inlet 184 that possesses a larger diameter than the lubricant fill inlet 120, and a funnel outlet 186 having a smaller diameter than both the lubricant fill inlet 120 and the funnel inlet 184. The funnel 180 is typically stored within the jug 100 with the funnel outlet 186 housed within the jug 100 by inserting the funnel outlet into the jug 100 through the lubricant fill inlet 120. The passage of the funnel inlet 184 into the jug 100 is stopped by the neck of the lubricant fill inlet 120 as it is of a smaller diameter than the funnel inlet 184.

A modular rack 200 is provided for the storage of a bag housing 30, a dispensing jug 100, and a spill containment module 220. The modular shelving rack 200 is constructed from a rigid material, preferably a metal or alloy. Each shelving module 250 of the modular rack 200 is a substantially hollow rectangular boxed frame having a top module wall 260, a base module wall 261 a first lateral module wall 262, a second lateral module wall 264, and a distal module wall 266 affixed by wall fastening means 222. The top module wall 260 possesses an outer top module wall face 270 and an inner top module wall face 272. The base module wall 261 possesses an base wall inner surface 273 and a base wall outer surface 275. Each lateral wall 262, 264 possesses a lateral wall inner surface 274 and a lateral wall outer surface 276. The distal wall 266 possesses a distal wall inner surface 278 and a distal wall outer surface 280. A module shelf 290 having a module shelf top surface 292 and a module shelf bottom surface 293 is affixed between the lateral walls 262, 264 to segregate each module into a top storage compartment 230 and a bottom storage compartment 240. The top storage compartment 230 is used to store a bag box 30. The bottom storage compartment 240 is used to store a jug 100. The shelving module 250 preferably lacks a connecting wall across the proximal side of the frame 255.

The top storage compartment 230, in a preferred embodiment, is of sufficient width to permit the insertion of a bag box 30, i.e. lubricant storage container 30, and not wide enough to permit the bag box 30 to move laterally enough to cause a misalignment between the bag box spigot 12 and the lubricant inlet port 120. The bottom storage compartment 240, in a further preferred embodiment, is the same width as the top storage compartment 230 but wider than the jug 100, therefore requiring the base module wall 261 to utilize a means to laterally align the jug 300, i.e. lubricant dispensing jug guide 300, beneath the bag box 30 by guiding the lateral sides of the jug 100 into the proper position. Ideally, the jug 100 possesses a depth from proximal to distal ends so as to allow the lubricant inlet port 120 to be correctly aligned with the spigot 12 along a pour proximal-distal axis when the jug 100 is fulling inserted into the bottom storage compartment 240. A screened drain pan module 210 with removable drain pan 215 is positioned beneath the module base wall 261 and an inserted jug so as to catch spills.

The shelving modules 250 may be coupled together in a vertically stacked manner and affixed to each other by a shelving module fastening means 252 (e.g. bolts, rivets, etc.) which functions to secure the top module wall 260 to the base module wall 261 of two shelving modules 250 stacked atop each other. Likewise, shelving modules 250 may be affixed horizontally across their lateral walls 262, 264. In a still further embodiment, the fastening means 252 may be removed to permit disassembly. The coupling of modules 250 permits the construction of a modular rack 200 that is configurable vertically and horizontally as needed to meet space requirements and restraints.

The top storage compartment 230 creates a housing which permits the shelving of a bag box 30 within the space defined by the confines of the inner surfaces 274, 276 of the lateral walls 262, 264 of both modules, the inferior surface 272 of the top module wall 260 of and the superior surface 292 of the module shelf 290.

The shelving modules 250 may be vertically coupled so that the outer surface 275 of the base module wall 261 of a top mounted module 250 is adjacent to the outer surface 270 of the top module wall 260 of a bottom mounted module 250. Likewise, shelving modules 250 may be horizontally coupled by affixing the outer surfaces 276 of the lateral walls 262, 264.

In a preferred arrangement, the bag box 30 is arranged above a jug 100 so that the bag box 30 may be drained into the dispensing jug 100 shelved immediately below the bag box 30. When the bag box 30 is placed into the top storage compartment 230 and seated against the inner surface 278 of the distal module wall 266 and the jug 100 is also seated against the inner surface 278 of the distal module wall 266, the bag box spigot 120 is aligned directly above and in close proximity to the lubricant fill inlet 120 on the jug 100.

While the system and processes of the present application have been particularly shown and described with reference to specific embodiments thereof, it will be understood by those skilled in the art that changes in the form and details of the disclosed embodiments may be made without departing from the spirit or scope of the application. In addition, although various advantages, aspects, and objects of the device system and processes of the present application have been discussed herein with reference to various embodiments, it will be understood that the scope of the application should not be limited by reference to such advantages, aspects, and objects. Rather, the scope of the application should be determined with reference to the appended claims.

What is claimed is:

1. A storage box having a vertical sight port for viewing the volume of an internally stored collapsible container comprising a box having at least three side walls for housing a collapsible container having a dispensing apparatus at its base to control the flow of contained material from said collapsible container; said box having an interior height, width, and depth; said box further possessing flaps which fold together to close at least one side wall of said box, said flaps being configured so as to fold to form a side wall having a vertical sight port for observing the material level in said collapsible container, said vertical sight port created from combining the negative space from said flaps upon folding; and wherein at least one said flap possesses a dispensing apparatus port that permits the dispensing apparatus affixed to said collapsible container to pass through said side wall and below said vertical sight port for operation of said dispensing apparatus outside of said storage box.

2. The apparatus of claim 1, wherein said storage box protective housing possesses chamfered base walls.

3. The apparatus of claim 2, wherein said storage box is constructed of cardboard.

4. A storage box having a vertical sight port for viewing the volume of an internally stored collapsible container comprising a box having at least three side walls for housing a collapsible container having a dispensing apparatus at its base to control the flow of contained material from said collapsible container; said box having an interior height, width, and depth; said box further possessing flaps which fold together to close at least one side wall of said box, said flaps being configured so as to fold to form a side wall having a vertical sight port for observing the material level in said collapsible container, said vertical sight port created from combining the negative space from said flaps upon folding, wherein at least one said flap possesses a dispensing apparatus port that permits the dispensing apparatus affixed to said collapsible container to pass through said side wall and below said vertical sight port for operation of said dispensing apparatus outside of said storage box.

5. The apparatus of claim 4, wherein said storage box possesses chamfered walls.

6. The apparatus of claim 5, wherein said storage box is constructed of cardboard.

7. A storage box having a vertical sight port for viewing the volume of an internally stored collapsible container comprising a box having at least three side walls for housing a collapsible container having a dispensing apparatus at its base to control the flow of contained material from said collapsible container; said box having an interior height, width, and depth; said box further possessing flaps which fold together to close at least one side wall of said box, said flaps being configured so as to fold to form a side wall having a vertical sight port for observing the material level in said collapsible container, said vertical sight port created from combining the negative space from said flaps upon folding, wherein at least one said flap possesses a dispensing apparatus port that permits the dispensing apparatus affixed to said collapsible container to pass through said side wall and below said vertical sight port for operation of said dispensing apparatus outside of said storage box, said storage box possessing chamfered base walls.

8. The apparatus of claim 7, wherein said storage box is constructed of cardboard.

* * * * *